United States Patent [19]

Perretta

[11] 4,270,451

[45] Jun. 2, 1981

[54] ZONE CONTROLLED DAMPENING MEANS

[76] Inventor: Frank Perretta, Aux. Rte. 2, Marlboro, N.Y. 12542

[21] Appl. No.: 29,195

[22] Filed: Apr. 12, 1979

[51] Int. Cl.[3] ..... B41F 7/30; B41L 25/06

[52] U.S. Cl. ..... 101/148; 101/365; 101/366

[58] Field of Search ..... 101/148, 147, 366, 363, 101/364, 207, 208, 210, 365; 239/220, 222.11, 222.13, 223, 224, 219; 261/90, 91, 92; 159/11 B

[56] References Cited

U.S. PATENT DOCUMENTS

| | | | |
|---|---|---|---|
| 1,667,291 | 4/1928 | Lavett | 239/220 |
| 2,622,520 | 12/1952 | Hauser et al. | 101/147 |
| 3,094,065 | 6/1963 | Roberts | 101/148 |

FOREIGN PATENT DOCUMENTS

| | | | |
|---|---|---|---|
| 2504778 | 8/1976 | Fed. Rep. of Germany | 101/148 |
| 47170 | 10/1936 | Netherlands | 239/220 |

*Primary Examiner*—J. Reed Fisher
*Attorney, Agent, or Firm*—Joseph L. Spiegel

[57] ABSTRACT

In a printing press of the lithographic type, a dampening system regulates the flow of dampening solution onto the oscillating roller for application to an adjacent dampener roller and then onto a plate cylinder. The dampening means includes a plurality of circumferentially grooved, longitudinally spaced discs, axially aligned and positioned adjacent to the oscillating roller. The grooved circumferences of the discs are so positioned as to be rotatable through a dampening solution source. A plurality of individually actuable means is each so positioned as to direct air under pressure at one of the grooved circumferences of the discs towards the oscillating roller. In this way dampening solution from the circumferential groove is directed into a fine spray onto the periphery of a section or zone of the oscillating roller. The system also includes means for controlling the amount of air directed from one of the air pressure means independent of every other air pressure means.

4 Claims, 2 Drawing Figures

ZONE CONTROLLED DAMPENING MEANS

BACKGROUND OF THE INVENTION

This invention relates to printing presses of the lithographic type and particularly to a zone controlled dampening means for such presses.

The prior art discloses various systems for depositing a dampening solution onto the oscillating roller of the printing press.

U.S. Pat. No. 176,193 to F. Rhell discloses a conventional dampening apparatus for lithographic presses using a water pan, pan roller and ductor roller to transfer water to the vibrator. U.S. Pat. Nos. 1,719,017 and 1,798,850 to S. Moe et al basically disclose spraying systems wherein moisture is directed onto the plate cylinder. Schultz U.S. Pat. No. 1,812,720 discloses a system using capillary action to wet a pan roller with moving belts. The system includes a conventional ductor roller to transfer water to the vibrator. Later Schultz U.S. Pat. No. 1,991,962 adds spray heads and needle valves to essentially the same system.

Stevens U.S. Pat. No. 2,231,694 uses a series of small pumps to deliver water through nozzles or needle valves but the system fails to achieve even distribution. On the other hand, Rogers U.S. Pat. No. 2,733,654 is directed to a conventional dampening arrangement wherein ink and water are applied to a form roller simultaneously using a pan roller and a ductor. The Rogers system does not eliminate variables between the ductor, pan roller and the distributor. U.S. Pat. No. 3,504,626 to E. W. Worthington discloses a conventional pan roller arrangement.

A further view of the prior art is shown illustrated in U.S. Pat. No. 2,183,568 to W. F. Huck wherein a perforated cylinder covered with an absorbent felt is fed water internally by a series of tubes. Smith U.S. Pat. No. 3,651,756 utilizes a spraying system employing a series of spray heads for applying water directly to the ink rollers and Klinger U.S. Pat. No. 3,924,531 uses spray heads or slingers to apply water directly onto the ink rollers.

In contrast to the prior art cited above, the present invention pertains to a unique zone controlled dampening system for regulating the flow of dampening solution onto the oscillating roller. The system includes a plurality of means longitudinally spaced along the oscillating roller, each independently controllable allowing more or less dampening solution onto the oscillating roller and without any of the disadvantages of the above cited prior art.

SUMMARY OF THE INVENTION

The present invention relates to a zoned controlled dampening means for regulating the flow of dampening solution onto the oscillating roller of a printing press. The system is comprised of a plurality of circumferentially grooved, longitudinally spaced discs axially aligned and positioned adjacent to the oscillating roller and a plurality of individually actuable means each adapted to direct air under pressure at one of the grooved circumferences of the discs toward the oscillating roller. The grooved circumferences of the discs are so positioned as to be rotatable through a dampening solution source. The air pressure means distributes dampening solution from the circumferential grooves into a fine spray onto a periphery of a section or zone of the oscillating roller.

An object of the invention is a zoned controlled dampening means for a printing press.

Another object is such a means with individually controllable dampening elements within such system.

BRIEF DESCRIPTION OF THE DRAWING

Other objects and advantages of the invention will be apparent from the following detailed description and accompanying drawing wherein.

DETAILED DESCRIPTION

Figure 1:
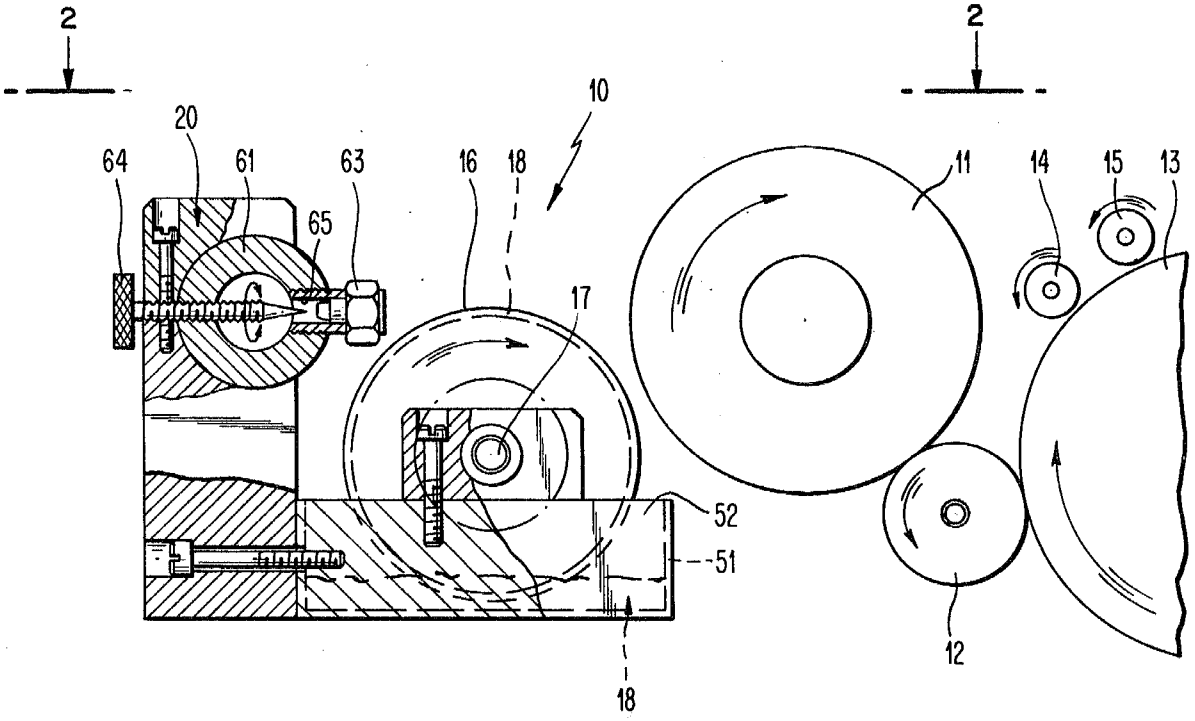
FIG. 1 is a side view, partially in schematic, of the invention showing the zoned controlled dampening means in conjunction with the oscillating roller and other portions of the printing press; and, FIG. 2 is a top view of the zone controlled dampening means of FIG. 1.

Referring now to FIG. 1 of the drawing, the zone controlled dampening means 10 of the present invention is illustrated for use in a printing press of the lithographic type.

The dampening means 10 of the invention is positioned adjacent to a vibrating or oscillating roller 11 which carries a dampening solution onto a dampener roller 12 and thence onto the plate cylinder 13. Ink rollers 14 and 15 are also illustrated adjacent to plate cylinder 13.

Figure 2:
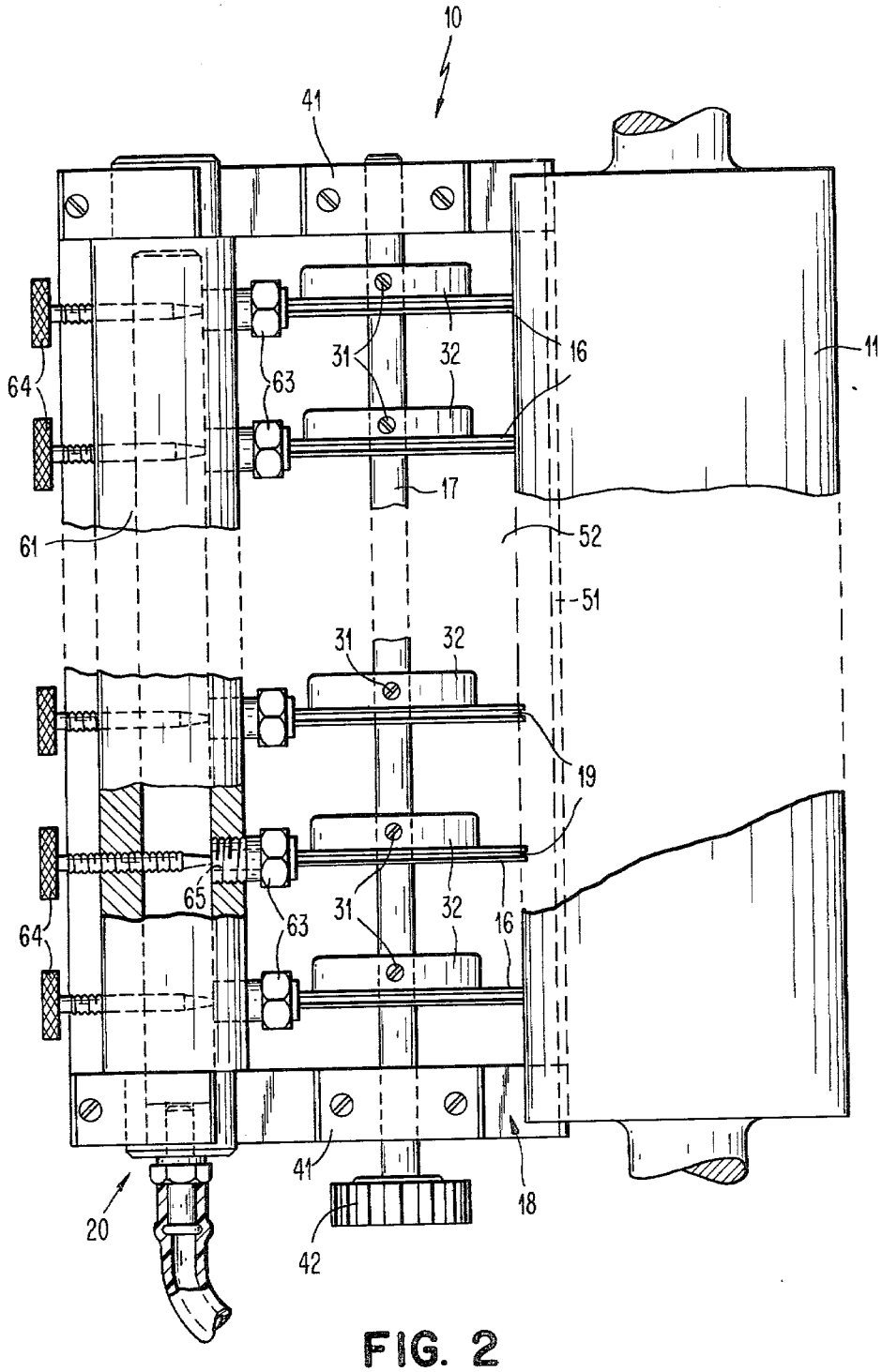

In accordance with the teachings of the present invention and as shown in FIGS. 1 and 2, the dampening means 10 is comprised of: a plurality of circumferentially grooved longitudinally spaced discs 16, positioned on a rotatable shaft 17, axially aligned and adjacent to oscillating roller 11; a dampening solution source 18 so positioned that the grooved circumferences 19 of the discs 16 can be rotated through the dampening solution source 18; and, individually actuable means 20 tangentially positioned with respect to discs 16 for directing air under pressure at the grooved circumferences 19 in a direction towards the oscillating roller 11 thereby distributing dampener solution from the circumferential grooves 19 into a fine spray onto the periphery of a section or zone of the oscillating roller 11.

The discs 16 are evenly spaced, typically one inch apart, to within one inch at each end of the ends of the oscillating roller 11 and are held in fixed position on shaft 17 by means of set screws 31 extending through disc hubs 32.

The discs 16 are of plastic or of stainless steel and in one embodiment were 2½ inches in diameter and one eighth inch thick.

Discs 16 are provided with circumferential grooves 19 which pick up water as the grooves pass through the dampening solution source 18. In one embodiment, the grooves were between 0.03–0.035 inches wide and 0.10 inches deep.

When rotating, discs 16 will carry within grooves 19 dampening solution from dampening solution source 18 to in front of air pressure means 20.

Shaft 17 to which discs 16 are attached is supported within pillow block 41. A timing pulley 42 is driven by a timing belt and variable speed motor (not shown). The shaft 17 is typically driven by the motor, when in use, at a speed of 180 r.p.m.'s. Speed, of course, will vary depending on the requirements of a particular form being run and on the speed of the press. Also, by varying speed, more or less solution will be picked up by the groove.

The dampening solution source 18 comprises simply a pan 51 containing dampening solution 52. Commonly, dampening solution 52 is an acidic solution (typical Ph value 4.5) containing gum arabic.

Air pressure means 20 is comprised of manifold 61 with compressed air fitting 62, air nozzles 63 and needle valves 64. Air under pressure is admitted via fitting 62 into manifold 61 and outwardly through nozzles 63 at the dampening solution within circumferential grooves 19.

The nozzles 63 are positioned tangentially with respect to discs 16 such that air from nozzles 63 will blow dampening solution from within the circumferential grooves 19 onto oscillating roller 11. The amount of air from nozzles 62 and hence the amount of dampening solution blown onto oscillating roller 11 is varied by needle valve 64. In a particular region or zone on roller 11 when no dampening solution is required or desired the needle valve 64 closes entirely the opening 65 within nozzle 63.

In one embodiment, nozzle air pressure was 10 pounds per square inch. The diameter of nozzle opening 65 was 0.025 inches and the distance between the opening 65 and disc 16 was 0.25 inches.

In use, the discs 16 are rotated through the pan 51 containing dampening solution 52. Dampening solution 52 is picked up within circumferential grooves 19. The valves 64 are adjusted to predetermined positions. Digital dials can be connected to the needle valves so as to permit reproducibility of positioning. More or less air passes through a given nozzle 63 by putting the valve further out or further in. The further in the valve 64, the less solution will be blown off a given disc thus, the amount of solution blown off a given disc is individually adjustable. The amount of dampening solution you may require in a given region could depend on what is being printed in that particular region.

In some instances when running half a web, in which case only half the roller need be dampened, the nozzles opposite the unused portion of the roller 11 are shielded to cover the nozzles.

The nozzles blow a fine spray of dampening solution onto the roller 11.

The arrangement of the present invention is distinguishable from prior art spray nozzle dampening systems in that air and dampening solutions are not sprayed through a nozzle which can get plugged. The air and solution come from separate sources. The solution is sprayed directly onto roller 11, nothing can feed back. The solution remains clear with no lint, papers dust or change in Ph value. The spraying system is self-cleaning and nonclogging.

What is claimed is:

1. A dampening means for use in a printing press having a plate cylinder, a dampener roller adjacent the plate cylinder for applying a dampening solution thereto, an oscillating roller adjacent the dampener roller, said dampening means comprising; a plurality of circumferentially grooved, longitudinally spaced discs, axially aligned and positioned adjacent to said oscillating roller; a dampening solution source; the grooved circumferences of said discs so positioned as to be rotatable through said dampening solution source; and, a plurality of individually actuable means each adapted to direct air under pressure at one of the grooved circumferences of said discs towards said oscillating roller thereby distributing dampening solution from said circumferential groove into a fine spray onto the periphery of a section of said oscillating roller.

2. The invention defined by claim 1 including means for controlling the amount of dampening solution distributed onto said oscillating roller.

3. The invention defined by claim 2 including means for controlling the amount of air directed from one of said air pressure means independent of every other air pressure means.

4. The invention defined by claim 2 including means for varying the rotation speed of said discs.

* * * * *